US005909202A

United States Patent [19]

Cathey

[11] Patent Number: 5,909,202

[45] Date of Patent: Jun. 1, 1999

[54] WIRE-BONDED GETTER IN AN EVACUATED DISPLAY AND METHOD OF FORMING THE SAME

[75] Inventor: David A. Cathey, Boise, Id.

[73] Assignee: Micron Technology, Inc., Boise, Id.

[21] Appl. No.: 09/024,938

[22] Filed: Feb. 17, 1998

Related U.S. Application Data

[63] Continuation of application No. 08/290,633, Aug. 15, 1994, Pat. No. 5,734,226, which is a continuation of application No. 07/930,097, Aug. 12, 1992, abandoned.

[51] Int. Cl.[6] ..... G09G 3/22

[52] U.S. Cl. ..... 345/74; 313/553

[58] Field of Search ..... 313/553–562; 345/74, 75

[56] References Cited

U.S. PATENT DOCUMENTS

| | | | |
|---|---|---|---|
| 3,322,993 | 5/1967 | Vinopal | 313/553 |
| 3,665,241 | 5/1972 | Spindt et al. | 313/351 |
| 3,755,704 | 8/1973 | Spindt et al. | 313/309 |
| 3,812,559 | 5/1974 | Spindt et al. | 445/50 |
| 4,352,119 | 9/1982 | Bardens et al. | 257/682 |
| 4,630,095 | 12/1986 | Otsuka et al. | 257/682 |
| 4,743,797 | 5/1988 | Emberson et al. | 313/553 |
| 4,835,441 | 5/1989 | Feller et al. | 313/553 |
| 4,925,741 | 5/1990 | Wong | 313/553 X |
| 5,060,051 | 10/1991 | Usuda | 357/67 X |
| 5,064,396 | 11/1991 | Spindt et al. | 445/50 |
| 5,223,766 | 6/1993 | Nakayama et al. | 313/558 X |
| 5,734,226 | 3/1998 | Cathey | 345/74 |

FOREIGN PATENT DOCUMENTS

| | | | |
|---|---|---|---|
| 2295032 | 12/1990 | Japan | 313/553 |
| 4004546 | 1/1992 | Japan | 313/553 |
| 4190544 | 7/1992 | Japan | 313/553 |

*Primary Examiner*—Amare Mengistu
*Assistant Examiner*—Ricardo Osorio
*Attorney, Agent, or Firm*—Walter D. Fields

[57] ABSTRACT

A wire serves as a gettering material which is wire-bonded to electrical connections which lead outside of a vacuum sealed package. The wire can be activated to create and maintain a high integrity vacuum environment. The "getter" can be either heat activated or evaporated by the passing of an AC or DC current through the wire.

34 Claims, 2 Drawing Sheets

WIRE-BONDED GETTER IN AN EVACUATED DISPLAY AND METHOD OF FORMING THE SAME

CROSS-REFERENCE TO RELATED APPLICATIONS

This is a continuation application of U.S. application Ser. No. 08/290,633, filed Aug. 15, 1994, now U.S. Pat. No. 5,734,226 issued Mar. 31, 1998; which is a continuation of application Ser. No. 07/930,097 filed Aug. 12, 1992 now abandoned.

FIELD OF THE INVENTION

This invention relates to flat panel displays, and more particularly to displays containing a vacuum.

BACKGROUND OF THE INVENTION

Cathode ray tube (CRT) displays, such as those commonly used in desk-top computer screens, function as a result of a scanning electron beam from an electron gun impinging on phosphors on a relatively distant screen. The electrons increase the energy level of the phosphors. When the phosphors return to their normal energy level, they release photons which are transmitted through the glass screen of the display to the viewer.

Field emission displays seek to combine the cathodoluminescent-phosphor technology of CRTs with integrated circuit technology to create thin, high resolution displays wherein each pixel is activated by its own set of cold cathode electron emitters. Flat panel display technology is becoming increasingly important in appliances requiring lightweight portable screens.

It is important in flat panel displays of the field emission cathode type that an evacuated cavity be maintained between the cathode electron emitting surface and its corresponding anode display face (also referred to as an anode, cathodoluminescent screen, display screen, faceplate, or display electrode.

There is a relatively high voltage differential (e.g., generally above 200 volts) between the cathode emitting surface (also referred to as base electrode, baseplate, emitter surface, cathode surface) and the display screen. It is important that electrical breakdown between the electron emitting surface and the anode display face be prevented. At the same time, the narrow spacing between the plates is necessary to maintain the desired structural thinness and to obtain high image resolution. The spacing also has to be uniform for consistent image resolution, and brightness, as well as to avoid display distortion, etc. Uneven spacing is much more likely to occur in a field emission cathode, matrix addressed flat vacuum type display than in some other display types because of the high pressure differential that exists between external atmospheric pressure and the pressure within the evacuated chamber between the baseplate and the faceplate. The pressure in the evacuated chamber is typically less than $10^{-6}$ torr. Accordingly, the term "vacuum" is meant to refer to negative pressures of this type.

Contamination by unwanted, residual gases in the vacuum chamber will effect the performance of the display. Residual gases may even cause destructive arcing in the display. For example, oxygen molecules trapped in the evacuated chamber must be immobilized. The wire bonded "getters" of the present invention function to precipitate the oxygen molecules out of the evacuated atmosphere, thereby minimizing the effect such oxygen molecules will have on the functioning of the display, and consequently the image produced thereon.

SUMMARY OF THE INVENTION

The present invention is an apparatus for removing residual gases from an evacuated display. The apparatus is comprised of a metallic wire disposed between two pads, which have electrical leads. The leads extend to the exterior of the display, where they are connected to a power source. When energy from the power source is applied, the wire becomes "hot"; i.e., chemically active. Gas molecules are adsorbed to and react with the wire once the wire has been heated, so that the wire thereby functions as a getter.

One advantage of the present invention is that the wire can be formed from a combination of conductive materials having different melting points. For example, the wire can be formed of titanium/tantalum in which titanium has a lower melting point than tantalum. As the titanium evaporates from the wire, a large surface area is created with which residual gases can react.

Further advantages of wire-bonding technology for getter placement are the low cost, the high throughput, and the ability to accurately locate the getter material in a small, tightly confined package.

BRIEF DESCRIPTION OF THE DRAWINGS

The present invention will be better understood from reading the following description of nonlimitative embodiments, with reference to the attached drawings, wherein.

DETAILED DESCRIPTION OF THE INVENTION

Figure 1:
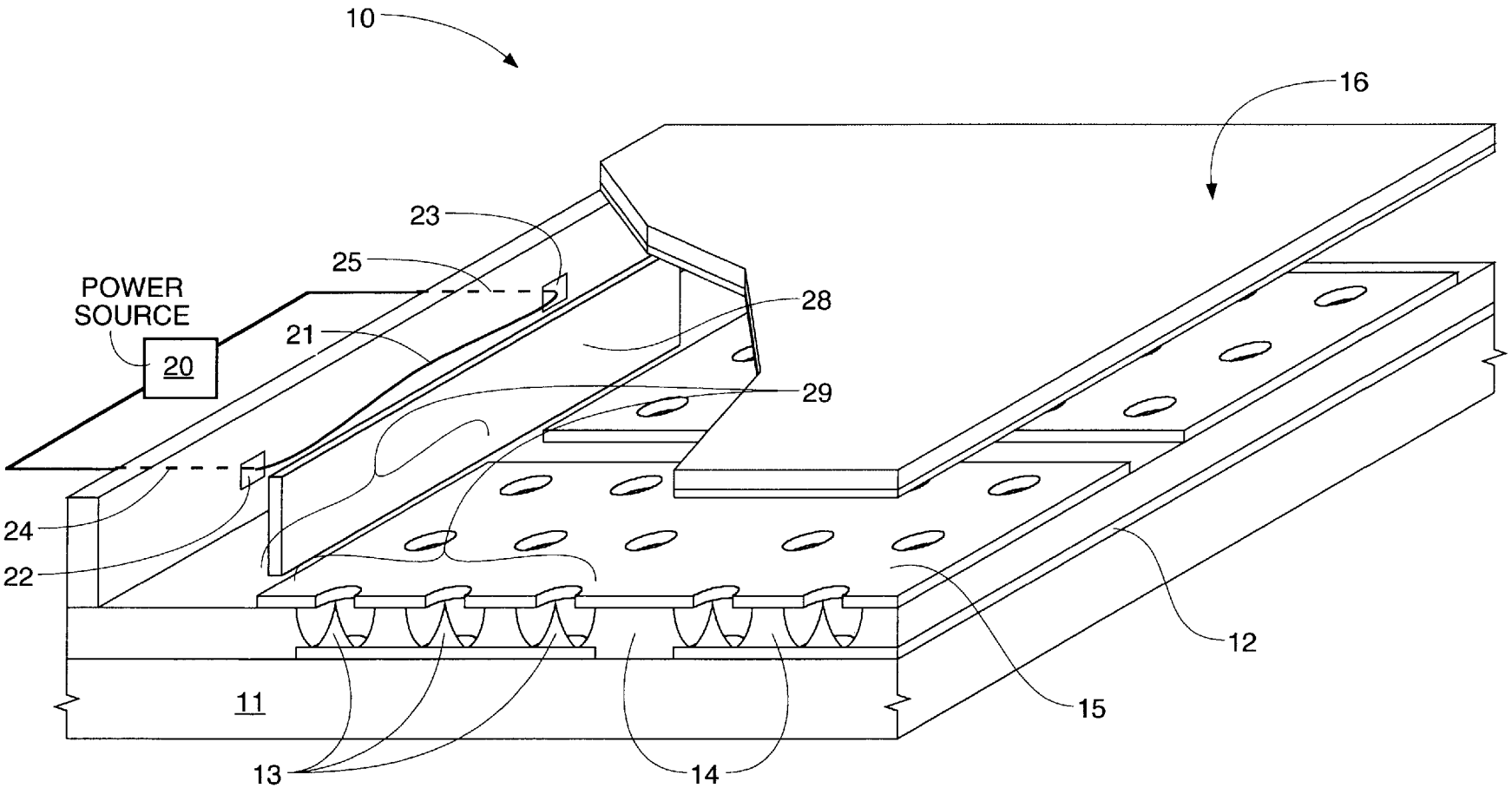
FIG. 1 is a cross-sectional schematic drawing of a field emission display device having the wire-bonded getter disposed therein.

Referring to FIG. 1, a field emission display 10 employing pixels 29 is depicted. A single crystal silicon layer serves as a substrate 11 onto which a conductive material layer 12, such as doped polycrystalline silicon has been deposited.

At a field emission site, a conical micro-cathode 13 has been constructed on top of the substrate 11. Surrounding the micro-cathode 13, is an anode gate structure 15 having a positive voltage with respect to the micro-cathode 13 during emission. When a voltage differential, through source 20, is applied between the cathode 13 and the gate 15, a stream of electrons is emitted toward a phosphor coated screen 16. Screen 16 is an anode on which is coated a layer of phosphor.

A dielectric insulating layer 14 is deposited on the conductive cathode layer 12. The insulator 14 also has an opening at the field emission site location.

Some sample field emitter displays are described by Spindt, et al., in U.S. Pat. No. 3,665,241, 3,755,704, 3,812,559 and 5,064,396.

Disposed between the faceplate 16 and the baseplate 11 are located spacer support structures (not shown) which function to support the atmospheric pressure which exists on the electrode faceplate 16 and baseplate 21 as a result of the vacuum which is created between the baseplate 21 and faceplate 16 for the proper functioning of the emitter tips 13.

A conductive metallic wire 21, preferably titanium/tantalum, is disposed between two pads 22, 23, which pads 22, 23 have leads 24, 25 to the exterior of the display. The leads 24, 25 are connected to a power source 20. When energy from the power source 20 is provided, the metallic wire 21 attracts and holds any residual gas molecules located in the vacuum sealed display envelope.

The wire 21 functions as a "gettering" material. A "getter" is reactive with the residual gases that happen to be present in the vacuum. The "getters" maintain a low-pressure environment by displacing or "gettering out" the unwanted gases.

The "getter" of the present invention is preferably a titanium/tantalum wire 21 (also referred to as a thread or filament) having a diameter of approximately 0.010 inches. The tantalum would heat from the passing of electrical current from power source 20 and evaporate the titanium into the vacuum environment. The titanium atoms are chemically active enough to combine with other gases in the vacuum which also accumulate on the vacuum walls. The material is removed from the chamber which reduces the pressure. For example, the titanium reacts with oxygen to form a solid, which solid precipitates out of the chamber.

Other suitable conductive materials can also be used to form the wire 21. One such metal is barium. Aluminum is also a possible alternative.

Figure 2:
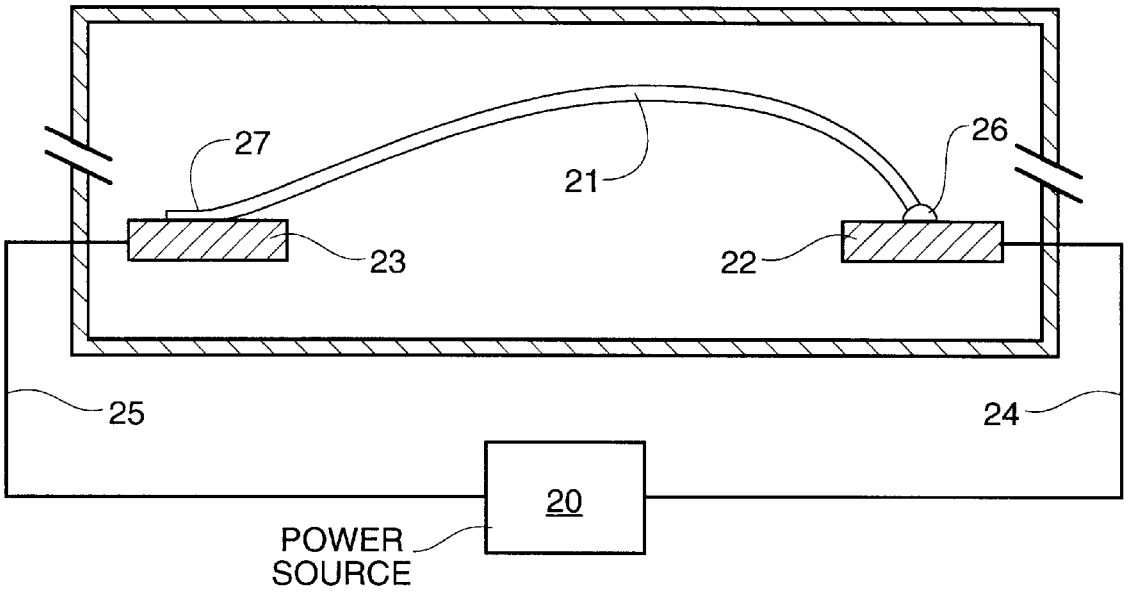
FIG. 2 is a schematic drawing of the wire-bonded getter of the present invention.

Referring to FIG. 2, the wire 21 is preferably wire-bonded at each end 26, 27, by any of the methods known in the art (e.g., ultra sonic ball bonds, thermocompression bonds, thermosonic bonds, wedge bonds, or stitch bonds) to a bond pad 22, 23. The bond pads 22, 23 can be made from any suitable material, but are preferably a conductive metal, such as tantalum, aluminum or gold. The "getter" can alternatively be pressed in place, welded in place, or simply loosely placed in the vacuum chamber.

Electrical connections 24, 25 lead out of the vacuum sealed display envelope to the power source 20. The power source 20 activates the "getter," and thereby a high integrity vacuum environment is created and maintained in the display unit. The wire 21 which serves as the "gettering" material can either be heat activated (by the passing of an AC or DC current through the wire) or evaporated (by the passing of a AC or DC current).

The "getter" can be disposed anywhere in the vacuum chamber, as long as the wire 21 does not interfere with the operation of the emitter tips 13 with anode screen 16. Hence, the preferred location of the wire is along the side of the display. There is wide latitude in the length of the wire 21 which will function as the "getter."

In the case of evaporation, atoms leave an evaporating surface in a straight line path of migration, and adhere to the first object with which they make contact. In such situations, a shield 28 may be disposed in the chamber to prevent the atoms from coating functional surfaces, such as the emitter tips. Thus, when the titanium evaporates from the wire 21, a physical shield 28 is one method by which to protect the display surfaces from the undesired coating of titanium. If the "getter" is thermal activated, the shield 28 is not necessary.

All of the U.S. patents and patent applications cited herein are hereby incorporated by reference herein as if set forth in their entirety.

While the particular wire bonded getters for use in flat panel displays as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, although the preferred embodiment is described with reference to field emitter displays, one with ordinary skill in the art would understand that the present invention could be applied to other display technologies which employ an evacuated cavity, such as for example, a cathode ray tube, a plasma display, or vacuum fluorescent display.

We claim:

1. A display apparatus with a getter, comprising:

a plurality of walls defining a chamber;

an electrically conductive bond region on at least one wall of said plurality;

a wire getter filament within said chamber comprising a reactive metal for gettering gas molecules therein, said wire getter filament having a first end and a second end; and a wirebond at the first end of said wire getter filament coupled to said electrically conductive bond region.

2. A display according to claim 1, further comprising a power receptor external said chamber to receive electrical energy, electrically coupled to said electrically conductive bond region.

3. An apparatus according to claim 1, further comprising:

another electrically conductive bond region on a wall of said plurality; and a second wirebond at the second end of said wire getter filament coupled to said another electrically conductive bond region.

4. A display according to claim 3, further comprising:

a first power lead external said chamber, electrically coupled to said electrically conductive bond region; and a second power lead external said chamber, electrically coupled to said another electrically conductive bond region.

5. An apparatus according to claim 3, wherein said first electrically conductive bond region and said second electrically conductive bond region are on a same wall.

6. An apparatus according to claim 1, wherein said wire getter filament comprises at least one of titanium and tantalum.

7. An apparatus according to claim 6, wherein said electrically conductive bond region comprises tantalum.

8. An apparatus according to claim 1, wherein said wirebond is an ultrasonic wirebond.

9. An apparatus according to claim 1, wherein said wirebond is a thermosonic wirebond.

10. An apparatus according to claim 1, wherein said wirebond is a thermocompression wirebond.

11. An apparatus according to claim 1, wherein one of said plurality of walls comprises an anode screen, and said apparatus further comprises an interior wall within said chamber disposed between said wire getter filament and said anode screen.

12. A display comprising:

a faceplate anode screen;

a baseplate having a plurality of cathode emitter tips disposed in opposing spaced relationship to said anode screen;

walls extending between said faceplate and said baseplate, said walls, faceplate and baseplate defining a chamber;

a bond pad on a surface within said chamber;

a getter wire within said chamber; and a first wirebond coupling a portion of said getter wire to said bond pad.

13. A display according to claim 12, wherein said bond pad is on one of said walls between said faceplate anode screen and said baseplate.

14. A display according to claim 12, further comprising a power lead electrically coupled to said bond pad, said power lead extending external said chamber.

15. A display according to claim 12, further comprising:

a second bond pad on a surface internal said chamber; and a second wirebond coupling a second region of said getter wire to said second bond pad.

16. A display according to claim 12, wherein said getter wire comprises at least one of titanium and tantalum.

17. A display according to claim 16, wherein said bond pad comprises tantalum.

18. A display according to claim 17, wherein said wirebond comprises one of an ultrasonic, thermosonic or thermocompression wirebond.

19. A field emitter display comprising:

a plurality of walls defining a cavity, said cavity being substantially evacuated;

a bond site on a surface within said cavity;

a getter wire having a first end and a second end; and a wirebond coupling said first end to said bond site.

20. A display according to claim 19, further comprising:

a second bond site disposed on a surface within said cavity; and a second wirebond coupling said second end of said getter wire to said second bond site.

21. A display according to claim 20, wherein one of said walls comprises an anode screen;

another of said walls comprises a cathode-field-emitter baseplate spaced in opposing relationship to said anode screen;

others of said walls comprise side walls extending between said anode screen and said cathode-field-emitter baseplate; and said bond site is on one of said side walls.

22. A display according to claim 20, wherein said walls comprise:

an anode screen plate, and a cathode-field-emitter baseplate spaced in opposing relationship to said anode screen; and wherein said getter wire is disposed between said anode screen plate and said cathode-field-emitter baseplate.

23. A display according to claim 22, further comprising an interior wall disposed between an image region of said anode screen plate and said getter wire.

24. A method of making a field-emitter display comprising steps of:

providing a wall;

wirebonding a getter wire to a surface of said wall; and combining said wall with other walls and forming a chamber with said getter wire internal the chamber.

25. A method according to claim 24, further comprising substantially evacuating said chamber.

26. A method according to claim 24, further comprising applying electrical energy to said getter wire and gettering gas molecules within said chamber.

27. A method according to claim 24, wherein one of said other walls comprises an anode screen, said method further comprising protecting said anode screen from said getter wire by providing a barrier therebetween.

28. A method according to claim 24, wherein said combining comprises:

providing an anode faceplate as one of said other walls;

disposing a cathode emitter baseplate in face-to-face, spaced relationship to said anode faceplate as another of said other walls; and positioning said getter wire between said cathode emitter baseplate and said anode faceplate.

29. A method of making a display comprising steps of:

providing a wall with a bond pad;

wirebonding a getter filament to said bond pad;

combining said wall with other walls to define a chamber, said getter filament inside said chamber; and gettering gases inside said chamber using said getter filament.

30. A method according to claim 29, wherein:

a first of said walls comprises a display faceplate;

a second of said walls comprises a base electrode plate;

others of said walls comprise sidewalls, said bond pad being located on one of said sidewalls; and said combining comprises spacing said base electrode plate in face-to-face opposing relationship to said display faceplate with said sidewalls joining perimeters of said display faceplate and said base electrode plate.

31. A method according to claim 30, wherein said wirebonding comprises one of ultra-sonic, thermosonic, and thermocompression wirebonding.

32. A method according to claim 29, wherein said step of gettering includes applying electrical energy to said getter filament.

33. A method according to claim 29, further comprising providing said wall with a second bond pad and wherein said wirebonding comprises wirebonding said getter filament to said first and second bond pads.

34. A method according to claim 29, wherein said getter filament comprises at least one of titanium and tantalum.

* * * * *